United States Patent [19]

Hoshino

[11] Patent Number: 4,898,062

[45] Date of Patent: Feb. 6, 1990

[54] HIGH HAT STAND WITH A ROTARY MEMBER

[75] Inventor: Yoshihiro Hoshino, Nagoya, Japan

[73] Assignee: Hoshino Gakki Co., Ltd., Japan

[21] Appl. No.: 333,563

[22] Filed: Apr. 4, 1989

[30] Foreign Application Priority Data

Aug. 24, 1988 [JP] Japan ..... 63-209726

[51] Int. Cl.[4] ..... G10D 13/02

[52] U.S. Cl. ..... 84/422.3

[58] Field of Search ..... 84/422.3

[56] References Cited

U.S. PATENT DOCUMENTS

| | | | |
|---|---|---|---|
| 2,417,972 | 3/1947 | D'Arcy | 84/422.3 |
| 3,530,757 | 9/1970 | Osuga | 84/422.3 |
| 4,145,951 | 3/1979 | Kobayashi | 84/422.3 |
| 4,449,440 | 5/1984 | Hoshino | 84/422.3 |
| 4,488,471 | 12/1984 | Youakim | 84/422.3 |

*Primary Examiner*—Lawrence R. Franklin

*Attorney, Agent, or Firm*—Ostrolenk, Faber, Gerb & Soffen

[57] ABSTRACT

A high hat stand for a pair of cymbals, including a support for a stationary cymbal and a vertically slidable coaxial operating rod for a cooperating movable cymbal. A spring returns the movable cymbal off the stationary one. A foot pedal operates the movable cymbal against the stationary cymbal. The connection between the foot pedal and the movable cymbal comprises a rotary member connected to and movable by the foot pedal and connected to move the operating rod for the movable cymbal. From the axis of rotation to its point of operative connection, the lever arm of the rotary member connected to the foot pedal is longer than the lever arm of the rotary member connected to the operating rod of the movable cymbal. The rotary member is defined either by a lever or a wheel. An additional swingable arm may be connected to the axis of the rotary member to enable the axis to swing with respect to the movable cymbal operating rod when the connection from the rotary member to the rod swings through an arc. This reduces the effect of lateral bias on the rod due to swinging of the lever as it rotates around its axis.

14 Claims, 10 Drawing Sheets

HIGH HAT STAND WITH A ROTARY MEMBER

BACKGROUND OF THE INVENTION

The present invention relates to a high hat stand including a cymbal operating rod that is moved up and down by a foot pedal. It particularly relates to a single rotary member that has different lever arm connections from the rotary member to the operating rod for the movable cymbal and to the pedal.

The high hat stand has a lower fixed cymbal and a cooperating upper movable cymbal above the lower cymbal. The upper movable cymbal is moved up away from the lower cymbal and down to engage the lower cymbal by up-and-down movement of an operating rod for the movable cymbal. That rod moves up and down in response to movement of a connected foot pedal at the lower part of the stand. The upper cymbal is normally urged away from the lower cymbal by a spring on or near to and connected to the operating rod. The performer presses on the pedal to overcome the spring force and move the cymbals together. In a high hat stand, high speed and accuracy of the action of the movable cymbal, i.e. highly responsive action, is required of the movable cymbal for the performer's musical performance to be accurately expressed. For the mechanism, this responsiveness arises from the pedal being stepped on lightly and being restored quickly to the original cymbals separated position. Because the operating rod is given a continuous upward bias by the spring, it is normally necessary to weaken the spring in order for the pedal to be stepped down lightly. But, in order for the pedal to be restored quickly, it is necessary for the spring to be stronger. These contradictory requirements are met by the present invention. Further, a mechanism is required that permits a delicate opening and closing of the movable cymbal and/or a mechanism is needed enabling the cymbals which are tightly closed together to slightly open or close by a delicate pedal operation.

In known high hat stands, an example of which is seen in FIG. 12 hereof, the cymbal, operating rod 100 is directly connected with the pedal 110. This causes the operating force, speed and distance of travel of the pedal 110 to be the same as for the cymbal operating rod 100. Moreover, a force, which is the same as the spring pressure of the spring device 105, is required for stepping on the pedal 110. In FIG. 12, a chain 107 connects a connector 106 for the spring of the spring device and the operating rod with the pedal 110.

Known direct connection structures do not improve upon the satisfaction of the basic requirements as they are merely cosmetic and are designed to change the feel of performance by the difference in the size of resistance or the strength of the spring.

SUMMARY OF THE INVENTION

Through experiments, the present inventor noted that the aforementioned requirements cannot be met as long as the pedal and the cymbal operating rod are directly connected together. Instead, it was found that the pedal and the cymbal operating rod should be connected through a rotary member that utilizes a differential lever operation principle.

The primary object of the invention is to provide a high hat stand which is very responsive.

Another object is to provide such a stand in which the pedal can be stepped on with a lighter force.

A further object is to provide such a stand in which restoration of the foot pedal is faster.

Yet another object is to provide such a stand in which the movable cymbal can be held firmly, yet a delicate pedal operation becomes possible.

Another object is to provide such a stand using the principle of the lever to operate the high hat stand.

In addition, this invention has as its object the provisions of a high hat stand, in which straight or axial motion of the cymbal operating rod is provided while the smooth movement of the rod and the smooth operation of the cymbal are assured.

In the invention, the cymbal operating rod is moved up and down through movement of the foot pedal. The cymbal operating rod and the pedal are connected through a single rotary member which is mounted on a rotary shaft. The distance (Y) from the rotary axis of the shaft to the cymbal operating rod connecting point along the rotary member is set smaller than the distance (X) from the rotary axis of the shaft to the foot pedal connecting point along the rotary member.

This can be accomplished according to the invention by having the rotary member operate at two appropriately different radii, so that each connecting point is at a different distance from the rotary axis.

The rotary member may comprise a pivotable lever arm which is attached at one end to swing around the rotary member axis. The lever is flexibly connected, through first connecting means, from a first connecting point toward the other swinging end of the lever to the swingable end of the foot pedal. At a shorter distance from the rotary shaft than the first connecting point, the lever has a second connecting point, at which second connecting means are connected and they extend to move the cymbal operating rod. The different distances (X) and (Y) to the connecting points are obtained in this way.

Alternately, the rotary member may comprise a wheel or a sprocket having a first radius from the rotary axis to a first connecting point spaced radially out from the axis, e.g. on the periphery of the wheel, of the desired lever arm length. A first flexible connecting means, like a flexible, link chain, partially wraps around the wheel and runs off the wheel tangentially to the swingable end of the foot pedal. The wheel serving as a rotary member has a benefit that the first connecting point is typically always at a constant angular position around the wheel, which is the point at which the first connecting means meets the wheel tangentially. The second connecting point from the wheel to the cymbal operating rod is spaced radially inward on the wheel from the periphery of the wheel. That second connecting point also rotates around the rotary axis with the wheel. A second flexible connecting means, like a flexible, link chain, also extends from the second connecting point on the wheel to the cymbal operating rod.

Furthermore, where the rotary member is either a pivoting lever whose second connecting point swings as the lever swings, or is a wheel whose second connecting point is in from the edge of the rotating wheel, in order to reduce the stress upon the operating rod due to the swinging of its flexible connecting means, the common rotary shaft or axis is held by the swinging end of a staggering or swinging arm which swings the common rotary shaft as the rotary member lever or wheel pivots or rotates, in order to compensate for the lateral force applied to the cymbal operating rod by the lateral shifting of the second connecting point.

Other objects and features of the present invention will become apparent from the following description of the preferred embodiments of the invention considered in conjunction with the accompanying drawings.

DESCRIPTION OF THE PREFERRED EMBODIMENTS

Figure 1:
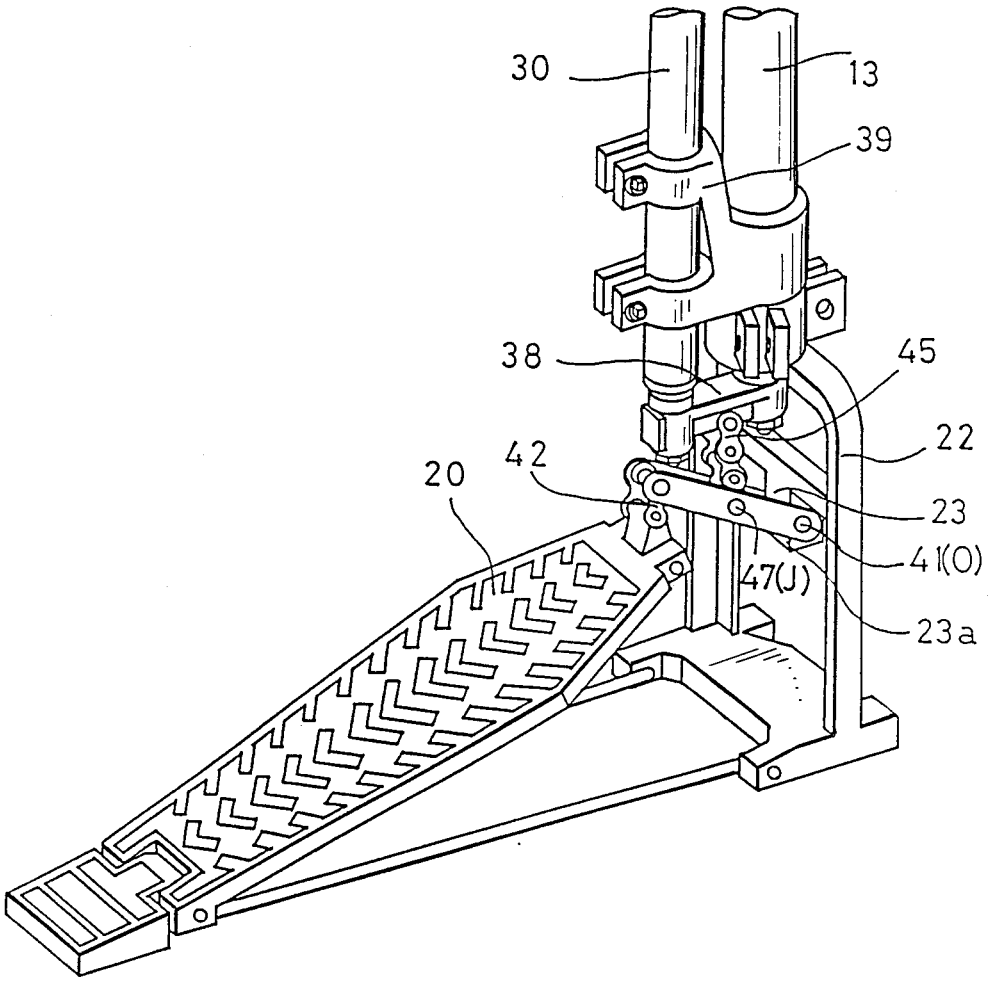
FIG. 1 is a perspective view of the bottom portion and essential features of the first embodiment of high hat stand of the present invention.
Figure 2:
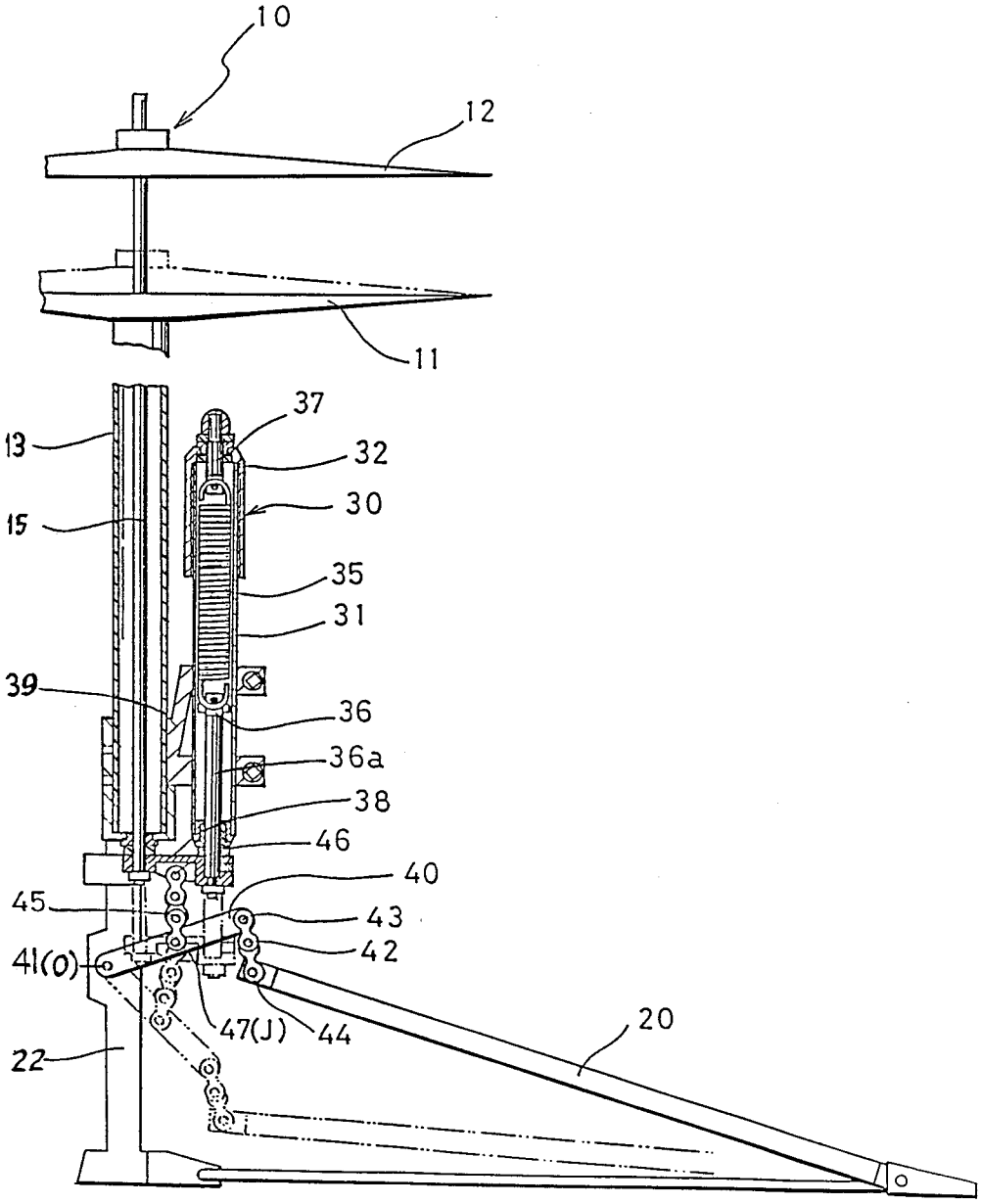
FIG. 2 is a vertical cross-section through the first embodiment of high hat stand of the present invention.

The structure of a high hat stand is explained with respect to the first embodiment of FIGS. 1 and 2. At the top of the high hat stand 10, there is a lower, upwardly facing, fixed cymbal 11 and an upper, downwardly facing, movable cymbal 12. The lower fixed cymbal 11 is fixed to the main pipe body 13 of the stand. The upper movable cymbal 12 is supported on a vertically movable cymbal operating rod 15 which passes through the main pipe body 13. The vertical movement of the operating rod 15 causes the upper cymbal to engage or separate from the lower fixed cymbal 11.

The operating rod 15 of the upper movable cymbal 12 is given an upward, cymbal separating bias at all times by a spring. It also receives such a bias by an additional spring device 30. The spring device 30 includes a main tubular body 31. An adjusting cap 32 is screwed to the top of the body 31. A coil spring 35 is held in a freely expandable and adjustable manner between the lower spring receiving member 36 on the lower portion of the main tubular body 31 and the upper spring receiving member 37 on the adjusting cap 32.

A bracket 39 supports the body of the spring device 30 on the main pipe body 13 of the stand. The rod part 36A below the lower spring receiving member 36 is connected with the movable cymbal operating rod 15 through a laterally extending connecting member 38, which affords the operating rod 15 with a continuous upward bias. There is a further spring which is directly wound on the operating rod 15 inside the main pipe body 13.

In the invention, the cymbal operating rod 15 and the foot pedal 20 which operates the rod 15 are connected by a rotary member which is supported to rotate on a rotary shaft on a rotary axis for enabling operation of the cymbal operating rod 15 by the foot pedal 20. The rotary member of this embodiment is in the form of a lever 40.

The lever 40 has one end that serves as a rotary fulcrum axis O for the lever. That end of the lever 40 is journaled by a pin 41 on the depending leg of a T-shaped member 23 that is provided on the front frame 22 of the pedal stand.

At the free swingable opposite end of the lever 40, a foot pedal 20 is connected through a connecting member, such as the flexible, link chain 42, or a similar device, through the connecting pins 43 and 44 at the ends of the chain 42.

A connecting point J is at a selected position along the lever 40 for operating the movable cymbal operating rod 15. The operating rod 15 is connected with the spring device 30 by the connecting member 38. The lever 40 is connected at point J to the chain 45. That chain 45 is attached to the member 38 and it is also attached to the lever 40 both by the connecting pins 46 and 47.

The location of the connecting point J for the operating rod 15 along the lever 40 is important, because it determines the operating or active point of the lever, and the magnitude of applied force varies with that location. In a practical relationship between the parts, when the lever length is one unit of length from the fulcrum or axis O, the length from the fulcrum O to the connecting point J of the operating rod is generally in a range between approximately 0.5 and 0.7 unit of length.

Figure 3:
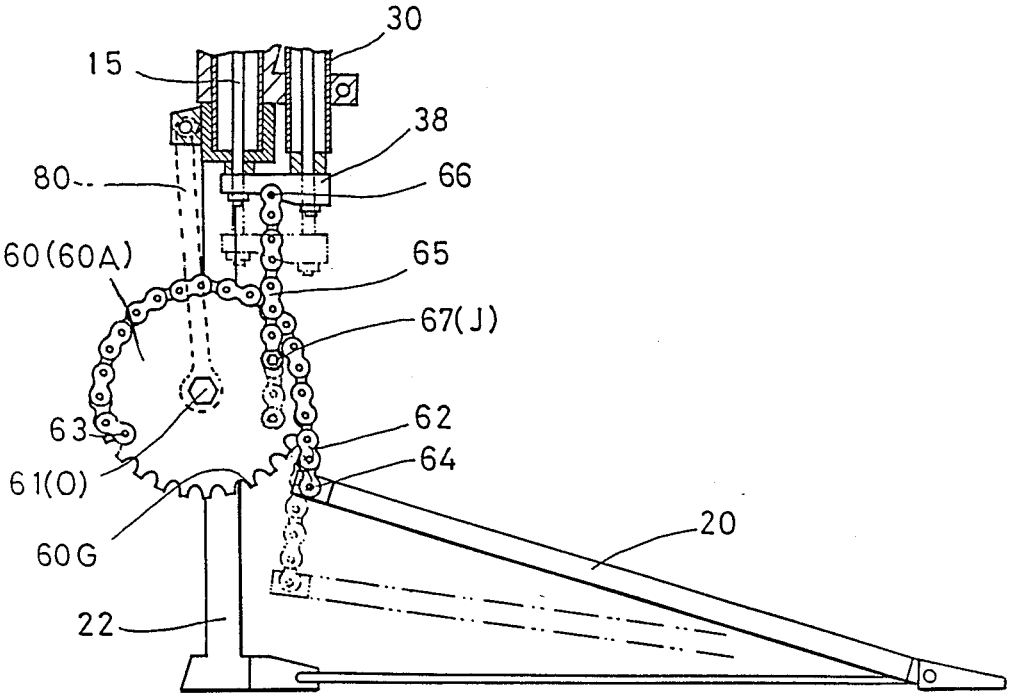
FIG. 3 is a partial cross section through the bottom portion and essential features of a second embodiment of a high hat stand of the invention.

In the second embodiment of FIG. 3, the rotary member comprises a wheel 60 in the form of a sprocket or a partial sprocket, instead of the lever 40. The wheel 60 rotates with the up-and-down pivoting movement of the foot pedal 20 around the pivot pin 61 at the axis O that is provided on the pedal stand 22. The flexible, link chain 62 to the free, swinging end of the foot pedal 20 is wound around the toothed periphery 60G of the wheel. The chain 62 is connected by connecting pin 63 at the periphery of the wheel 60 and at the end of pedal 20 by the pin 64.

A connecting point J for the cymbal operating rod 15 is formed at the desired radial distance from the axis O in from the periphery 60G of the wheel 60. Flexible, link chain 65 is the connecting member connected to the connecting point J at pin 67 and to the connecting member 38 at the pin 66. The length of the lever arm between the rotary axis O and the periphery 60G at the tangential run off point of the connecting chain 62 for the foot pedal is the radius of the wheel 60, while the distance from the axis O to the connecting point J for the cymbal operating rod 15 is always shorter than the radius of the wheel 60.

The specific locations of the connecting points is important based on the principle discussed for lever 40. The magnitudes of the applied forces on the operating rod and on the pedal vary according to the radial spacing of the locations of the connecting or force points. With the wheel 60 as the rotary member also, when the distance between the rotary shaft axis O and the connecting point to the foot pedal is one unit of length, then the distance from that axis O to connecting point J for the cymbal operating rod 15 is approximately in a range between 0.5 and 0.7 unit of length which is a most practical and easy to use arrangement.

The connecting point to the chain 62 on the wheel 60 is at a particular angular location around the wheel 60, at about the 120° position in FIG. 3, and that connecting point remains in that angular location as the wheel 60 rotates. The chain 62 is tangent to the wheel 60 there.

The moments of force on the operating rod and on the pedal have a relationship between the force applied and the lever length or distance. For example, it is easier to use a device in which when the distance (X) from the rotary shaft (O) to the second foot pedal connecting point (Q) is 1, then the distance (Y) from the rotary shaft (O) to the first cymbal operating rod connecting point J is substantially in a range between 0.5 and 0.7. This increases the force to the rod 15, as compared to that applied to the pedal 20 at (Q), and this reduces the travel distance of the rod 15 for the corresponding distance traveled by point (Q).

Figure 4A:
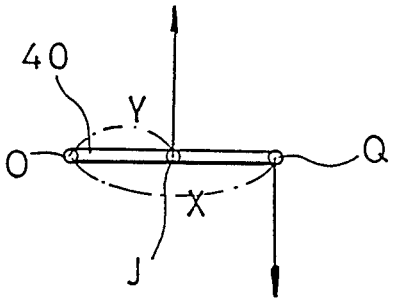
FIGS. 4A–4B shows the principles governing the action of the present invention.
Figure 4B:
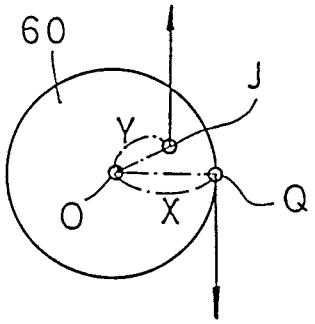

FIGS. 4A and 4B show the principle that governs the action of the rotary members in both of the two embodiments. FIG. 4A shows the rotary member as a lever 40 and FIG. 4B shows the rotary member as a wheel 60. Each rotary member has a fulcrum or axis O, a connecting point J that sets the lever arm to the operating rod 15 and a connecting point Q that determines the lever arm to the foot pedal. This becomes clear in connection with FIG. 5. Since the lever 40 and the wheel 60 are homogeneous relative to the operating principle and function of this invention, the following explanation is given in connection with the lever embodiment.

Figure 5:
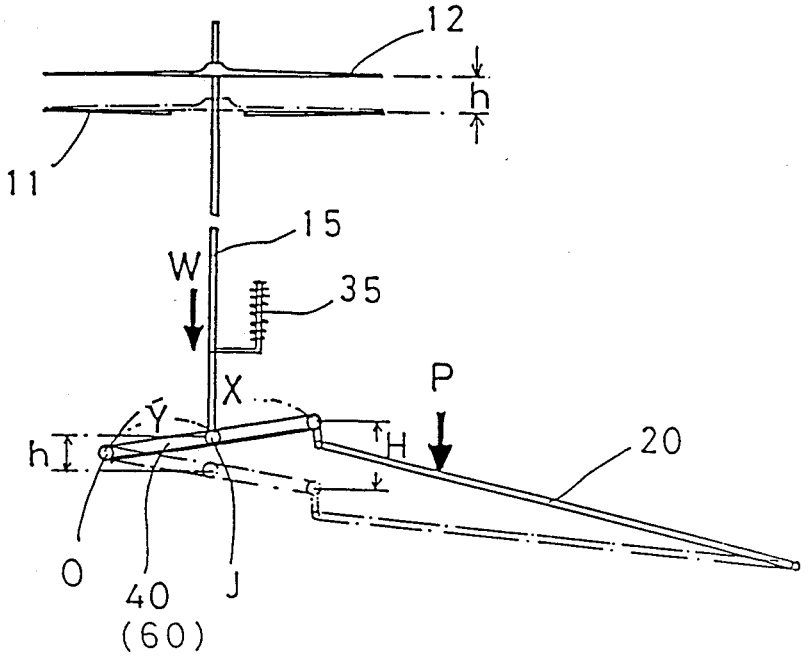
FIG. 5 is a schematic view indicating the action of a high hat stand according to the present invention.

FIG. 5 schematically shows the principle governing the action of the high hat stand of the present invention. The force W that pulls down the movable cymbal 12 multiplied by the length Y of the lever arm from the axis O to the connecting point J equals the force with which the pedal 20 is stepped on P multiplied by the length of the arm X. The force that is required to pull down the cymbal W against the bias of the spring 35 or the force with which the pedal is stepped on P can be made smaller or lighter as the ratio of Y as compared with X becomes smaller or, in other words, as the functional point J approaches the axis O.

On the other hand, the operating distance H of the pedal 20 that is required to pull down the cymbal 12 by a selected distance H is inversely proportional to the ratio of Y to X of the wheel 60 and the lever 40. In other words, the stroke of the pedal will have to be increased as the functional point J comes closer to the axis O.

A more detailed explanation appears in FIG. 6 for an actual high hat stand. FIGS. 6A–6D conceptually illustrate the various functions in the case where the X:Y length ratio of the rotary members is set at 1:0.5 units of length measurement, that is at the center of the lever or at a half way location along the radius of the wheel 60.

The comparison between this example and a conventional high hat stand is shown as Table 1 below.

TABLE 1

| | a Conventional Product | b Invention A having the same spring pressure as in the conventional product | c Invention B having a greater spring pressure than the conventional product (1.5 times) |
|---|---|---|---|
| Set pressure of the spring | F | F | 3/2 F |

TABLE 1-continued

| | a Conventional Product | b Invention A having the same spring pressure as in the conventional product | c Invention B having a greater spring pressure than the conventional product (1.5 times) |
|---|---|---|---|
| Force required for the pedal | F | 1/2 F (light) | 3/4 F (light) |
| Pressing force of the cymbal (at the time when the leg force is expressed by P) | P-F | minus 2 P-F (closes tightly) | minus 2 P-3/2 F (closes tightly) |
| Operating Distance of the cymbal at the time when the pedal is moved by S millimeters | S | 1/2 S (delicate action becomes possible) | 1/2 S (delicate action becomes possible) |
| Speed with which the pedal is restored | V | 2 V (fast) | = 2 V (1 + α) Approximately equal to 2V (one plus (alpha) (faster by the stronger portion (alpha) of the spring)) |

Figure 6A:
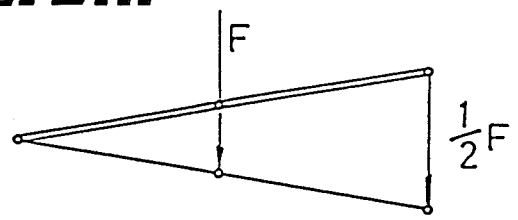
FIGS. 6A–6D are schematic or diagrammatic views showing the various functions of the present invention.

In FIG. 6A, if the spring pressure that is applied to the cymbal operating rod 15 is expressed by F, the force that is required for stepping on the pedal can be one-half F. This shows that the pedal of the invention can be stepped on with a smaller force than the pedal in a conventional product, provided that the spring pressure remains the same (in the case of Invention A in Table 1). As a result, an operating rod return spring having a greater spring force than in the past can be employed. In Invention B in Table 1, the pedal can be stepped on with a smaller force ($\frac{3}{4}$) than in the conventional high hat stand, even when a spring whose spring pressure is 1.5 times as large as for a spring in the conventional stand is used.

Figure 6B:
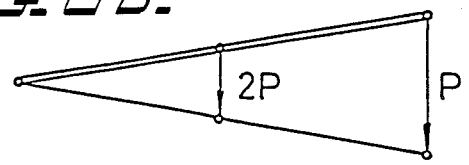

FIG. 6B shows that a force of 2P is applied to the movable cymbal at the time when the pedal is stepped on with a force of P, when the movable cymbal contacts the fixed cymbal and they are in a closed state. Actually, the cymbals are pressed with a force of 2P, minus pressure F of the spring. Tight closing of the cymbals can be achieved, as compared with the conventional force of P minus F, thereby making it possible to realize tight closing for better performance.

Figure 6C:
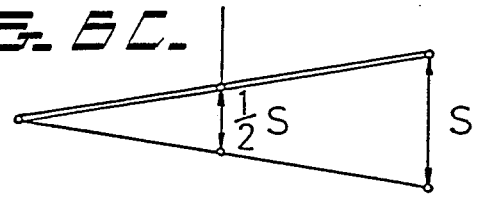

FIG. 6C indicates that the cymbal moves by a distance of one-half S millimeters or mm when the pedal is moved by a distance of S mm. On the principle of a lever, the distance becomes twice as great when the force become one half as large.

The above explanation shows that the pedal operation can be carried out "light and easy," and the invention is highly useful for the fine performing technique of delicate opening or closing while the cymbal is kept in a closed state.

Figure 6D:
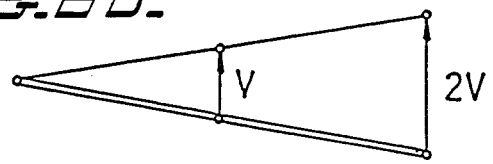

FIG. 6D shows that the pedal is restored at the speed 2 V when the cymbal operating rod is restored at the speed V. This restoration causes the plate of the pedal to seem to the performer to stick to the sole of his foot. It gives a pleasant feeling to the performer and improves the performing technique.

Figure 7:
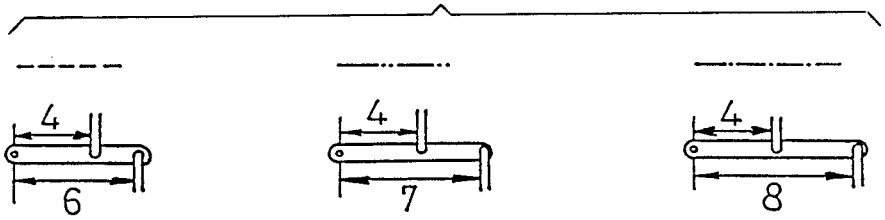
FIGS. 7, 7A, and 7B graph the operations of the invention and a conventional stand.
Figure 7A:
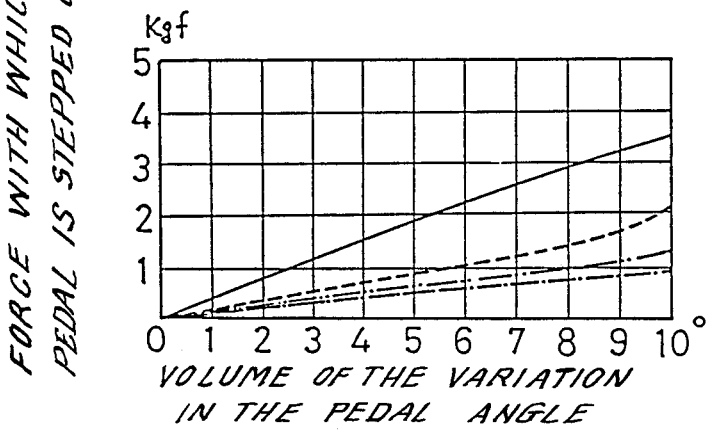
Figure 7B:
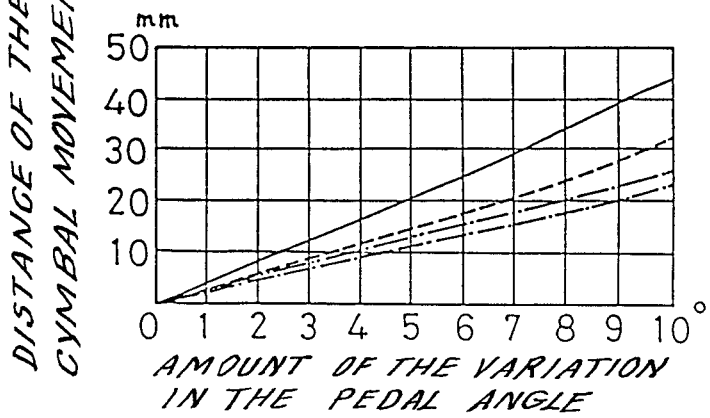

FIG. 7 graphs measurements made on an actual high hat stand and shows the relationship between the pedal stroke and the stepping force FIG. 7A and the relationship between the pedal stroke and the distance which the cymbal moves in FIG. 7B, in the case where the operating rod connecting point J was changed in the rotary member.

As shown, the broken line indicates the case where X:Y is 6:4 (the length Y is 0.67 when the length X is 1); the one-dot chain indicates the case where X:Y is 7:4 (the length Y is 0.57 when the length X is 1); and the two-dot chain indicates the case where X:Y is 8:4 (the length Y is 0.5 when the length X is 1). The solid line indicates the conventional product in which the operating rod and the pedal are directly connected.

The high hat stand of the first embodiment of FIG. 1 in which a lever is employed for the connection between the pedal and the cymbal operating rod, has superior effects stemming from its reliance upon levers.

As it is possible to step on the pedal with a smaller force, it is possible to drastically change the conventional pedal stepping feeling to the performer, with the operability being greatly improved. If deemed necessary, it is also possible to employ a return spring which is stronger than the return springs used in the past, thereby increasing the range from which the springs to be used can be selected.

Since it is also possible to hold the cymbal with a stronger force, it is possible to realize a tight closing at the time when the cymbals are brought together, thereby making it possible to offer a clear and sharp performance.

Because the operating distance of the pedal becomes large as compared with the operating distance of the cymbal operating rod, it becomes further possible to effect delicate movements, and it is thereby possible to carry out repetitive operations of cymbal opening and closing in a simple manner.

Moreover, the restoration of the pedal becomes faster and the pedal gives such a feeling to the performer that it seems to stick to the sole of his foot, thereby affording the performer a pleasant feeling and, at the same time, improving his performing technique.

With the single rotary member, the cymbal operating rod is connected to the foot pedal through a single rotary member, designed so that the distance Y from the rotary shaft 0 of the cymbal operating rod connecting point is smaller than the distance X from the rotary shaft to the foot pedal connecting point on the lever. Those stands having this structure have the function and produce the effect based on the lever principle, as already described.

In the stand shown in FIG. 1, where the rotary member for the cymbal operating rod 15 is the lever 40, the cymbal operating rod connecting point J moves in an arc with the rotary shaft O of the rotary member as the center. This produces deviations of the orientation of connecting chain, which extends between the lever and the rod, away from the axis of the operating rod 15 as the cymbal operating rod moves up and down. The rod 15 is urged to tilt by those deviations and resulting frictional resistance to up and down movement of the rod develops in pipe sliding part through which the rod moves, thereby causing a feeling of heaviness in operation.

An arrangement is needed to produce smooth straightforward motion of the cymbal operating rod with a lever. This is accomplished by absorbing the so-called deviations of the connection to the operating rod by appropriately shifting or swinging the position of the rotary axis O at pin 41A of the rotary member lever 40A by means of a swinging or staggering arm 70.

Figure 8:
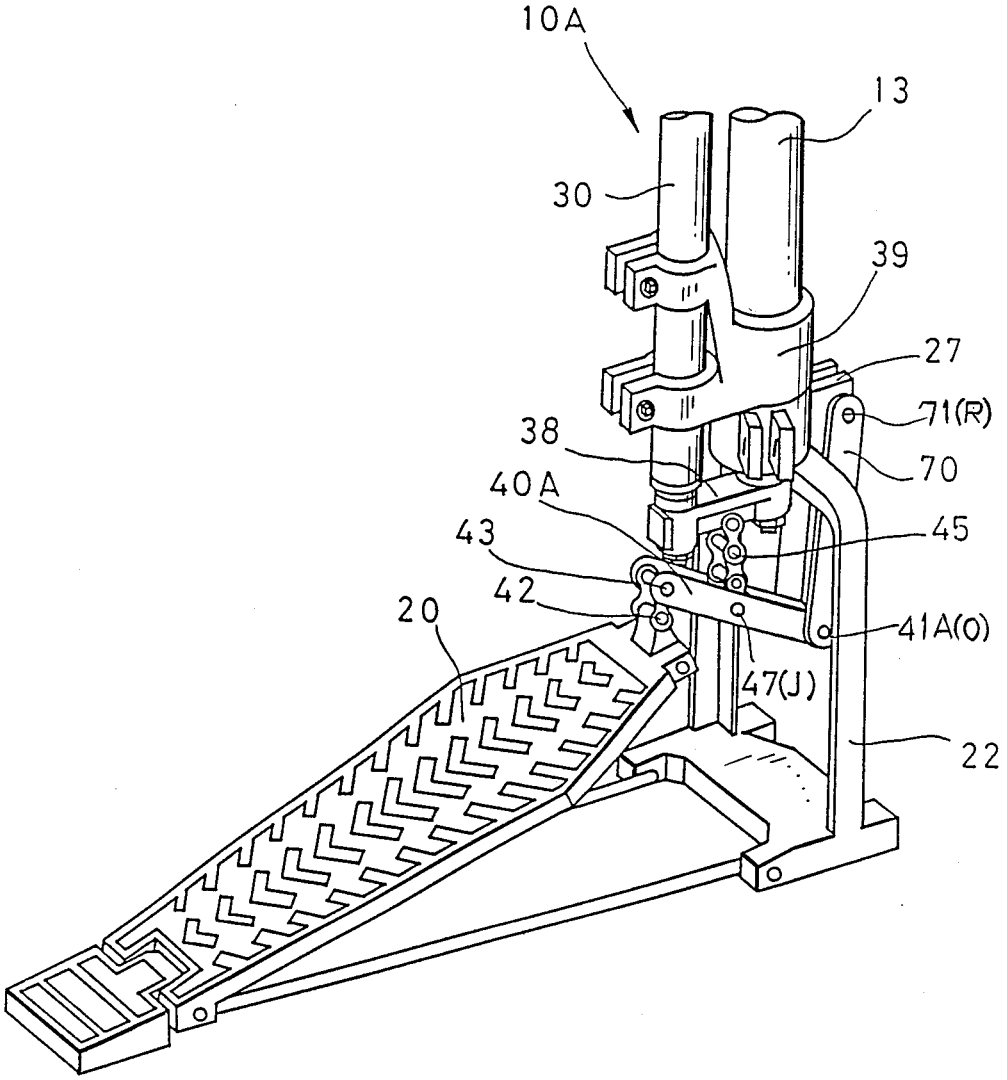
FIG. 8 is an oblique view of the same structure of a third embodiment of the high hat stand.
Figure 9:
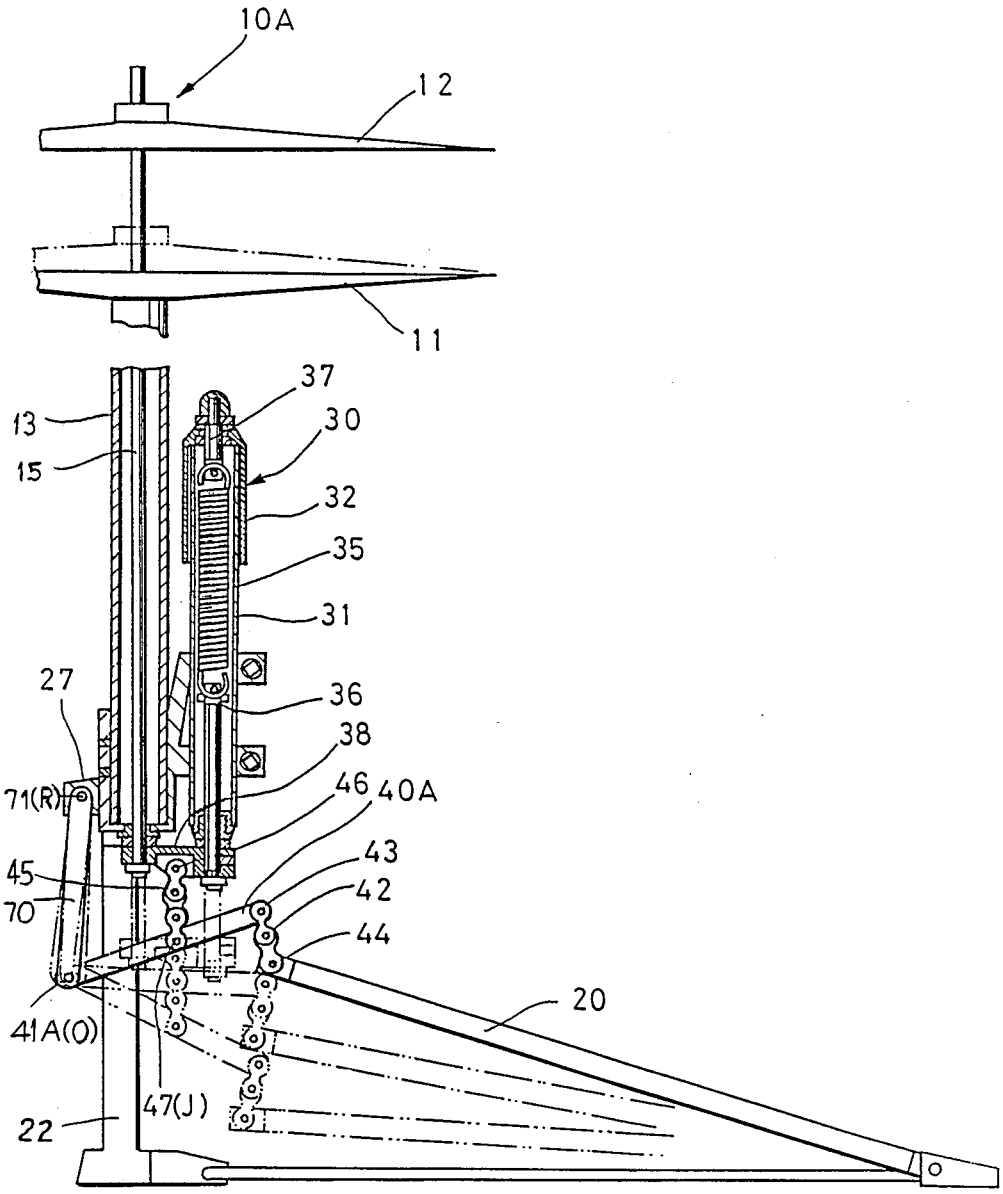
FIG. 9 is a vertical section through a high hat stand including the embodiment of FIG. 8.

In the case off the high hat stand 10A shown in FIGS. 8 and 9, the staggering arm 70 is provided for the high hat stand shown in either of FIGS. 1 and 2. Since the stand of FIG. 10A has the same constituent parts except for the staggering mechanism, the same reference numbers are used to simplify the explanation.

In the high hat stand 10A, a staggering arm 70 is journaled to pivot at pivot axis R by pin 71 at the upper protrusion 27 of the pedal stand 22. The swivable end of the staggering arm 70 is joined by the pin 41A with the rotary shaft O of the lever 40A, which is the rotary member, and lever 40A is held in this manner. Pin 71 on the side of the stand 22 serves as the axis or swing center R for the staggering arm 70, and 41A is an installing pin between the staggering arm 70 and the lever 40A.

Even where the wheel 60 is used as the rotary member as shown in FIG. 3, it is possible and useful to provide a staggering arm. In FIG. 3, a staggering arm 80 is connected with the wheel 60A. The staggering arm 80 attached to the rotary shaft O of the wheel 60A by the pin 61 is also not held stationary by the frame of the pedal stand 22, but is instead held at the axis R of the staggering arm 80 in a free swinging fashion.

Figure 10A:
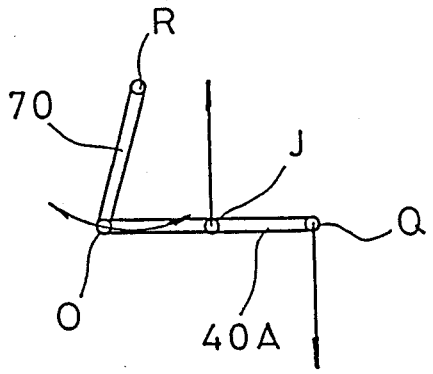
FIGS. 10A and 10B show the principle governing the action of the rotary member.
Figure 10B:
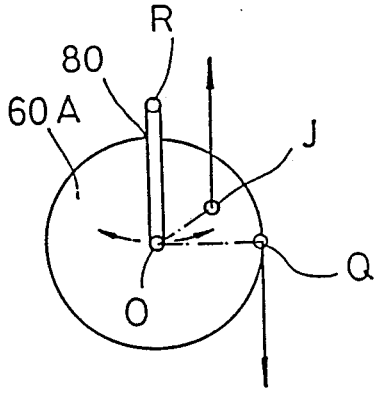
Figure 12:
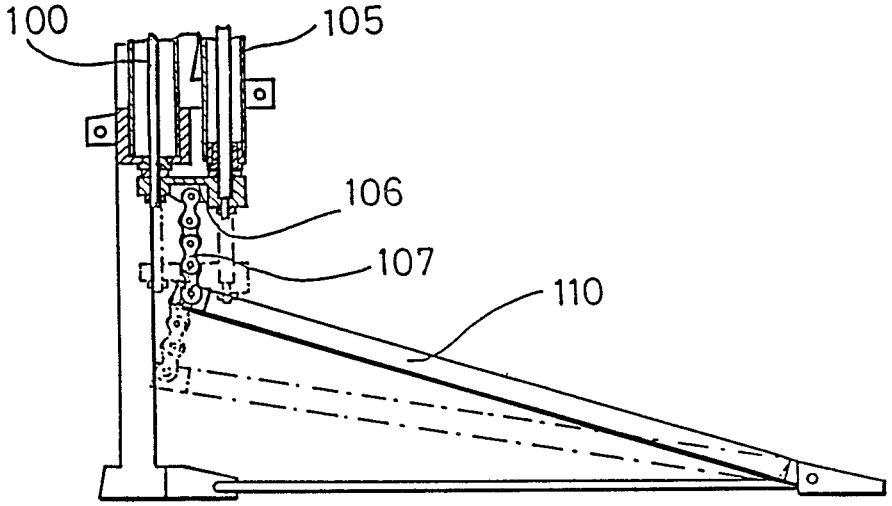
FIG. 12 PRIOR ART
FIG. 12 is a schematic cross sectional view through a prior art high hat stand.

FIGS. 10A and 10B show the principle governing the action of the rotary members with FIG. 10A showing the lever 40A and FIG. 10B showing the wheel 60A. Both of the rotary members 40A and wheel 60A have a rotary fulcrum or axis O, a connecting point J at a shorter distance from the axis O for the connecting means to the cymbal operating and connecting point Q at a longer distance from the axis O for the connecting means to the pedal end. Both operate based upon the principle of the lever. At the same time, the rotary member swings in an arc with the staggering arms 70 and 80 moving around the fulcrum or axis R.

Figure 11A:
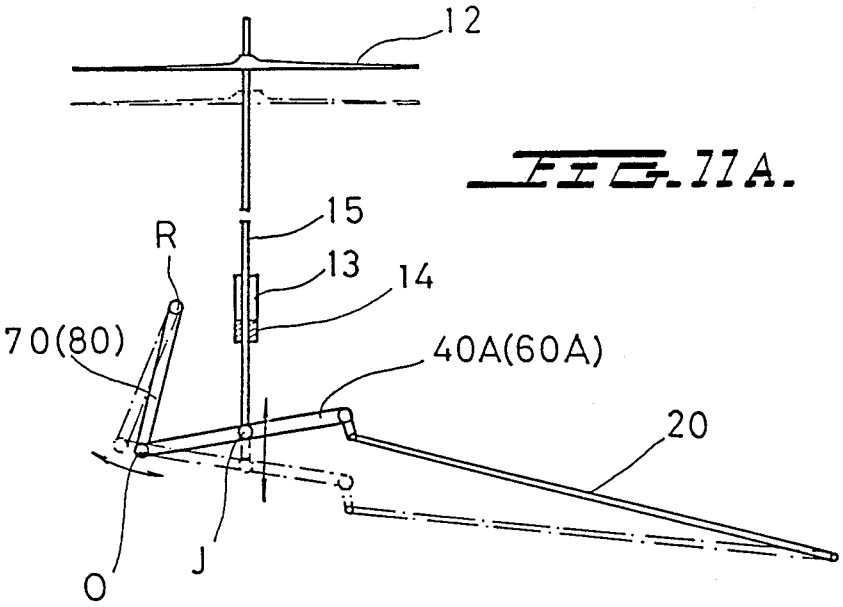
FIG. 11A and 11B are schematic views showing the action of the cymbal operating rod in accordance with the present invention.

The operation of this high hat cymbal stand is explained in FIG. 11A. The operations for lever 40A and wheel 60A are the same, so that only the lever is described. In FIG. 11A, the up-and-down pivoting movement of the foot pedal 20 primarily rotates the rotary member lever 40A around the rotary axis O as the center. By the rotation of the rotary member, the cymbal operating rod connection point J engages in arcuate movement. This produces a friction resistance to movement of the rod, due to the sliding of the sliding part 14 of the pipe 13 with respect to the moving cymbal operating rod 15, and the movement of point J attempts to cause deviations in the path of movement of the rod 15 which produces that resistance.

The above swinging of point J and the friction resistance produces lateral motion of the rotary member 40A or 60A around the axis R due to the staggering arm 70 or 80. As a consequence, the friction resistance is absorbed and, at the same time, smooth straightforward motion of the cymbal operating rod 15 is secured. FIG. 9 shows the connecting means 45 from lever 40A to connecting part 38 as a flexible link chain, which helps absorb the effect of the arcuate motion of point J. But the staggering arms 70, 80 would even permit a stiffer connecting means between the two parts 38 and 40A.

Figure 11B:
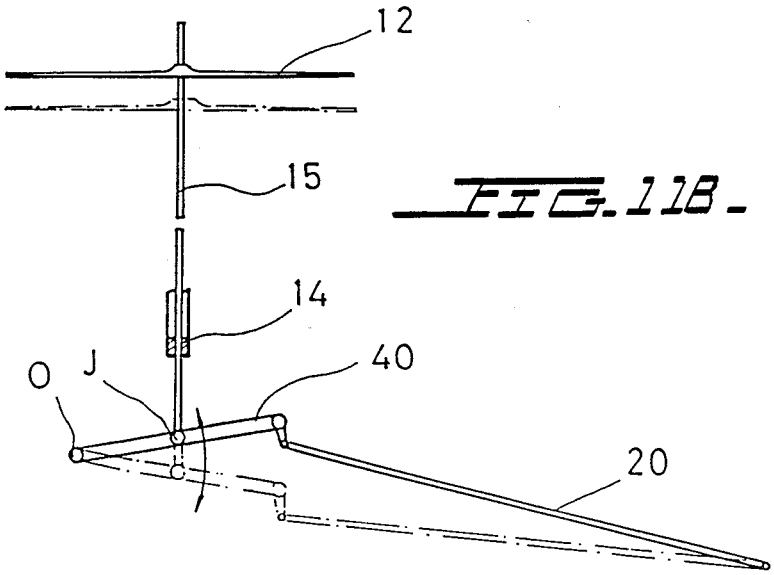

FIG. 11B shows an example in which there is no staggering arm, for the purpose of comparison. As has already been described, the cymbal operating rod connecting point J engages in arcuate movement, with the rotary axis O of the rotary member as the center. The rod 15 is tilted when the rod 15 moves up and down. This produces frictional resistance vis-a-vis the pipe sliding part 14, thereby making the operation heavy.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A high hat stand for cymbals comprising:

a support for a stationary cymbal and a stationary cymbal carried on the support;

a movable cymbal and an operating rod on which the movable cymbal is supported, the operating rod being movable for moving the movable cymbal in a first, contacting direction to move the movable cymbal into engagement with the stationary cymbal and in a second, out of contact direction for moving the movable cymbal out of engagement with the stationary cymbal;

a pedal operable in one direction for moving the operating rod to move the movable cymbal in the first, contacting direction, and the pedal being movable in the opposite direction for permitting movement of the operating rod in the second, out of contact direction;

a rotary shaft having an axis that extends across the direction of movement of the operating rod in the first, contacting and second, out of contact directions;

a rotary member on the shaft, a first connecting point on the rotary member and spaced a first distance from the axis of the rotary shaft, first means connecting the first connecting point on the rotary member to the operating rod, such that the operating rod is acted upon by a force produced by a lever arm of the length from the axis of the rotary shaft to the first connecting point; a second connecting point on the rotary member and spaced a second distance from the axis of the rotary shaft, second means connecting the second connecting point to the pedal, such that movement of the pedal moves the second connecting point and rotates the rotary member around the shaft;

wherein the first effective radius of rotation between the shaft and the first connecting point is smaller than the second effective radius of rotation between the shaft and the second connecting point.

2. The high hat stand of claim 1, further comprising biasing means normally urging the operating rod in the second, out of contact direction, and the pedal being operable for moving the operating rod in the first contacting direction against the bias of the biasing means, and reduction of force on the pedal enables the biasing means to return the operating rod in the second out of contact direction.

3. The high hat stand of claim 2, wherein the biasing means is supported separated from the movable cymbal operating rod; extending means extend from the biasing means to the operating rod for transmitting the biasing force from the biasing means to the operating rod; the first connecting means extending into connection with the operating rod by being connected to the extending means between the biasing means and the operating rod.

4. The high hat stand of claim 1, wherein the rotary member comprises a wheel having a periphery, the second connecting point is at the periphery of the wheel and the second connecting means extends from the second connecting point at the periphery of the wheel to the pedal.

5. The high hat stand of claim 4, wherein the second connecting point remains generally at a particular angular location around the wheel as the wheel rotates, and the second connecting point is the point at which the second connecting means tangentially contacts the wheel.

6. The high hat stand of claim 5, wherein the rotary member wheel comprises a sprocket and the second connecting means between the wheel and the pedal comprises a chain with links complementary to the sprocket, such that as the rotary member sprocket rotates, the chain is selectively drawn onto or permitted to move off the sprocket.

7. The high hat stand of claim 1, wherein the rotary member comprises a lever, with the lever extending from the shaft to and past the first connecting point and to the second connecting point.

8. The high hat stand of claim 1, wherein the rotary member comprises a wheel rotatable on the rotary axis, the first connecting point is on the wheel spaced radially from the shaft, and the second connecting point is also on the wheel spaced a greater distance from the shaft than the first connecting point.

9. The high hat stand of claim 1, wherein when the distance from the rotary shaft to the second connecting point is 1 unit of distance, then the distance from the rotary shaft to the first connecting point is in the range of between 0.5 unit and 0.7 unit of distance.

10. The high hat stand of claim 1, further comprising a swingable staggering arm connected to the support at a first axis location along the staggering arm and connected to the rotary shaft at a second location spaced from the first location along the staggering arm for supporting the shaft for swinging along with the swingable staggering arm around the first location, such that lateral stress, which is applied to the operating rod by the first connecting means connected to the rotary member due to the rotation of the rotary member, may at least in part be absorbed by the swinging of the staggering arm, and the resultant swinging of the rotary shaft to a position helping to relieve the lateral stress upon the operating rod.

11. The high hat stand of claim 10, wherein the rotary member comprises a lever extending from the shaft and to the first connecting point and to the second connecting point.

12. The high hat stand of claim 10, wherein the rotary member comprises a wheel rotatable on the rotary axis, the first connecting point is on the wheel spaced radially from the shaft, and the second connecting point is also on the wheel spaced a greater distance from the shaft than the first connecting point.

13. The high hat stand of claim 10, wherein when the distance from the rotary shaft to the second connecting point is 1 unit of distance, then the distance from the rotary shaft to the first connecting point is in the range of between 0.5 unit and 0.7 unit of distance.

14. The high hat stand of claim 1, wherein the operating rod is generally vertical and is supported for vertical motion, the rotary shaft axis is horizontal, the pedal is supported for pivoting motion vertically around the horizontal rotary shaft axis, and the part of the pedal connected with the second connecting means is spaced from the horizontal pivot axis of the pedal.

* * * * *